US007614294B2

(12) United States Patent
Hegeman et al.

(10) Patent No.: US 7,614,294 B2
(45) Date of Patent: Nov. 10, 2009

(54) SYSTEMS AND METHODS FOR DOWNHOLE FLUID COMPATIBILITY

(75) Inventors: Peter S. Hegeman, Stafford, TX (US); Anthony R. H. Goodwin, Sugar Land, TX (US); Moin Muhammad, Edmonton (CA); Ricardo Vasques, Sugar Land, TX (US); Cosan Ayan, Kadikoy (TR); Michael O'Keefe, Tasmania (AU); Tsutomu Yamate, Kanagawa-Ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 97 days.

(21) Appl. No.: 11/746,201

(22) Filed: May 9, 2007

(65) Prior Publication Data

US 2008/0066537 A1 Mar. 20, 2008

Related U.S. Application Data

(60) Provisional application No. 60/845,332, filed on Sep. 18, 2006, provisional application No. 60/882,359, filed on Dec. 28, 2006.

(51) Int. Cl.
*E21B 49/10* (2006.01)

(52) U.S. Cl. ..... 73/152.39

(58) Field of Classification Search ..... 73/152.23, 73/152.24, 152.28, 152.39, 152.41, 152.42, 73/152.55

See application file for complete search history.

(56) References Cited

U.S. PATENT DOCUMENTS

| | | | | |
|---|---|---|---|---|
| 3,243,122 | A | 3/1966 | Snaper | |
| 3,456,504 | A * | 7/1969 | Bombardieri | 73/152.39 |
| 3,908,454 | A | 9/1975 | Mullins et al. | |
| 3,993,131 | A * | 11/1976 | Riedel | 436/27 |
| 4,353,249 | A | 10/1982 | Lagus et al. | |
| 4,366,862 | A | 1/1983 | Brandell | |
| 4,392,376 | A | 7/1983 | Lagus et al. | |
| 4,535,843 | A | 8/1985 | Jageler | |
| 5,246,862 | A * | 9/1993 | Grey et al. | 436/28 |
| 5,411,082 | A | 5/1995 | Kennedy | |
| 5,488,990 | A * | 2/1996 | Wadleigh et al. | 166/260 |
| 5,635,636 | A | 6/1997 | Alexander | |
| 5,715,890 | A | 2/1998 | Nolen | |
| 5,829,520 | A * | 11/1998 | Johnson | 166/250.01 |
| 6,065,544 | A | 5/2000 | Holbert | |
| 6,301,959 | B1 | 10/2001 | Hrametz et al. | |
| 6,478,096 | B1 | 11/2002 | Jones et al. | |
| 6,766,854 | B2 | 7/2004 | Ciglenec et al. | |
| 6,939,717 | B2 * | 9/2005 | Jiang et al. | 436/121 |
| 7,062,958 | B2 * | 6/2006 | Diakonov et al. | 73/152.23 |

(Continued)

FOREIGN PATENT DOCUMENTS

| | | |
|---|---|---|
| EP | 0999344 | 6/2004 |

(Continued)

*Primary Examiner*—John Fitzgerald
(74) *Attorney, Agent, or Firm*—Dave R. Hofman; Darla Fonseca; Jaime Castano

(57) ABSTRACT

Methods for performing downhole fluid compatibility tests include obtaining an downhole fluid sample, mixing it with a test fluid, and detecting a reaction between the fluids. Tools for performing downhole fluid compatibility tests include a plurality of fluid chambers, a reversible pump and one or more sensors capable of detecting a reaction between the fluids.

14 Claims, 16 Drawing Sheets

U.S. PATENT DOCUMENTS

| | | | | |
|---|---|---|---|---|
| 7,100,689 | B2 * | 9/2006 | Williams et al. | 166/264 |
| 7,114,566 | B2 * | 10/2006 | Vinegar et al. | 166/256 |
| 7,402,424 | B2 * | 7/2008 | Raghuraman et al. | 435/287.1 |
| 7,427,504 | B2 * | 9/2008 | Torgersen et al. | 436/28 |
| 7,432,109 | B2 * | 10/2008 | Raghuraman et al. | 436/163 |
| 2002/0153137 | A1 | 10/2002 | Ziauddin et al. | |
| 2003/0134426 | A1 * | 7/2003 | Jiang et al. | 436/121 |
| 2004/0026125 | A1 | 2/2004 | Meister et al. | |
| 2004/0104341 | A1 | 6/2004 | Betancourt et al. | |
| 2004/0129874 | A1 * | 7/2004 | Torgersen et al. | 250/255 |
| 2004/0219064 | A1 * | 11/2004 | Raghuraman et al. | 422/68.1 |
| 2004/0231841 | A1 | 11/2004 | Niemeyer et al. | |
| 2005/0155760 | A1 | 7/2005 | Hill et al. | |
| 2006/0060351 | A1 | 3/2006 | Heathman et al. | |
| 2006/0162935 | A1 | 7/2006 | MacDougall | |
| 2008/0066904 | A1 * | 3/2008 | Van Hal et al. | 166/250.1 |

FOREIGN PATENT DOCUMENTS

| | | |
|---|---|---|
| EP | 1710393 | 10/2006 |
| GB | 1256537 | 12/1971 |
| GB | 2390105 | 3/2003 |
| GB | 2412171 | 9/2005 |
| GB | 2434862 | 8/2007 |
| WO | WO98/42948 | 10/1998 |
| WO | WO0111189 | 2/2001 |
| WO | WO0229205 | 4/2002 |
| WO | WO2007027617 | 3/2007 |

* cited by examiner

SYSTEMS AND METHODS FOR DOWNHOLE FLUID COMPATIBILITY

CROSS-REFERENCE TO RELATED APPLICATIONS

This application claims priority from Provisional Application Ser. No. 60/845,332, filed Sep. 18, 2006, the complete disclosure of which is hereby incorporated herein by reference. This application also claims priority from Provisional Application Ser. No. 60/882,359, filed Dec. 28, 2006, the complete disclosure of which is hereby incorporated herein by reference. This application is related to Ser. No. 11/562,908, having an electronic filing receipt date of Nov. 22, 2006, the complete disclosure of which is hereby incorporated herein by reference.

BACKGROUND OF THE INVENTION

1. Field of the Invention

This invention relates broadly to oil and gas exploration or production. More particularly, this invention relates to systems and methods for testing and analyzing the compatibility of a reservoir with treating fluids, wellbore fluids, and the compatibility of these fluids with each other.

2. State of the Art

It is well known in the arts of oil and gas exploration and production that it can be advantageous to introduce certain fluids into the well bore and/or the formation. For example, during drilling, fluid is typically introduced into the annulus between the drill string and the wellbore. During exploration, fluid may be injected into the formation in order to obtain information related to the formation. During production, certain additives may be injected into the formation to enhance production.

Before introducing any significant quantity of fluid into the wellbore or the formation, it is desirable to determine whether the fluid will create an undesirable reaction. Thus, one or more fluid compatibility tests are preferably performed prior thereto. The testing process may include checks for compatibility of treating fluids and/or wellbore fluids with a reservoir formation and reservoir fluids. In general, fluids are compatible if their mixture does not adversely affect the permeability of the formation, or cause the development of any undesirable products (such as asphaltenes, waxes, or scale) in the wellbore, production tubing, surface facilities, and flowlines.

Where treating fluids are to be utilized, the treating fluid should remove existing damage (typically caused during drilling) without creating additional damage such as precipitates or emulsions through interactions with the formation rock or fluids. In extreme cases, it is possible that a seemingly benign fluid can create significant reactions that may permanently damage the permeability of the reservoir.

Presently, fluid compatibility tests are performed in a laboratory using fluids obtained from a wellbore and/or formation. In some cases, the fluids are obtained using a borehole tool which samples formation fluids as is well known in the art. A tool is lowered into a borehole which traverses a formation and is then brought into contact with the formation. A formation fluid sample is obtained by reducing the pressure in the borehole tool below the formation pressure. The tool with the fluid sample is then brought to the surface. The fluid sample is retrieved and sent to a laboratory for testing. Other methods for obtaining a fluid sample are known in the art, and include retrieving a sample from a producing well, during well testing or during well production exploitation.

The previously incorporated applications disclose downhole tools for formation testing via injection of non-formation (test) fluids into the formation and thereafter sampling the formation fluids. The tools include various sensors and circuits for monitoring and analyzing downhole formation fluid characteristics. However, it is desirable that, before injecting anything into the formation, compatibility tests be performed. It would be desirable if fluid compatibility tests could be performed downhole either contemporaneous with or prior to the testing which requires injection of non-formation fluids into the formation.

SUMMARY OF THE INVENTION

It is therefore an object of this disclosure to provide systems and methods for downhole fluid compatibility testing and analysis.

It is another object of this disclosure to provide systems for delivering test fluids downhole.

It is a further object of this disclosure to provide systems for collecting fluid samples downhole.

It is another object of this disclosure to provide systems for collecting test fluids downhole.

It is also an object of this disclosure to provide downhole systems for selectively mixing a test fluid with a fluid sample.

It is another object of this disclosure to provide systems for injecting test fluids into the formation.

It is an additional object of this disclosure to provide downhole systems for detecting and analyzing reactions that take place in the mixture of test fluid and fluid sample.

It is still another object of this disclosure to provide downhole systems for determining the compatibility of a test fluid with a downhole fluid sample based on the detected and analyzed reaction of their mixture.

It is yet another object of this disclosure to provide methods for determining downhole the compatibility of test fluids with formation fluids or drilling fluids.

In accord with these objects, which will be discussed in detail below, according to an exemplary embodiment, the disclosed systems include a tool having a plurality of chambers for storing test fluids and a mixing chamber. The chambers are connected to flowlines, a pump and a plurality of valves for obtaining downhole fluid samples and selectively delivering two or more fluids into the mixing chamber. The mixing chamber may include some mixing means, e.g. a spinner. The mixing chamber is provided with one or more sensors (inside or outside the chamber) for detecting the occurrence of a reaction in the mixing chamber. A circuit or circuits coupled to the one or more sensors are used in interpreting the output of the sensor(s) and making a determination of fluid compatibility. In some cases, the circuits are coupled to telemetry equipment for conveying the results of the test to surface equipment and for receiving instructions regarding sampling and testing. In other cases, the sampling and testing process is controlled by a downhole controller using executing software instructions stored on a memory chip. Generally, if no reaction is detected, the fluids are determined to be compatible. If a reaction is detected, then the consequences of this reaction are evaluated with respect to the intended use of the test fluid. For example, on the one hand, asphaltene is typically encountered in medium to heavy oil reservoirs. It is known that concentration increases with decreasing API gravity (increasing density) and increasing viscosity of the reservoir oil. On the other hand, carbon dioxide injection can be used to maintain the pore pressure in a reservoir despite depletion of the reservoir through production. However, carbon dioxide injection can cause the precipitation of asphaltene which is often detrimental to production because it may reduce the permeability of the reservoir. Thus, if carbon dioxide test fluid produces a detectable precipitation of asphaltene, it will be considered incompatible with the reservoir fluids. The asphaltene precipitation can be detected with an optical scattering detector of the type described in the art, or any other method.

According to an alternate embodiment, downhole samples are obtained by capturing a core and processing it in the tool to extract a formation fluid sample. In another alternate embodiment, tests are conducted in-situ by injecting a test fluid into the formation and providing one or more sensors which are specifically located so that they are capable of detecting a reaction occurring at the injection site. According to another alternate embodiment, a test fluid is injected into the formation, allowed to mix with formation fluid and the mixture is extracted from the formation into the tool where the reaction is detected and analyzed.

Combined test fluid and fluid sample collected at a first depth can be injected back into the reservoir at a second depth. Also, the fluid injected at the first depth and then recovered at a first depth can be treated and/or purified for re-injection at a second depth. The first and the second depth may be the same or different. Injection rate and injection pressure may be sensed and analyzed.

According to other alternate embodiments, the test fluids may be placed in chambers before the tool is delivered downhole; the test fluids can be obtained downhole from the wellbore (e.g. drilling mud or completion fluid); the test fluid can be supplied as needed from the surface (e.g., via coiled tubing); the test fluid can be generated downhole (e.g., heating water to obtain steam as a test fluid or reacting two or more chemicals to generate a desired fluid); the test fluid may be obtained in-situ from another formation zone during the same or an earlier logging run.

Test fluids suitable for use in accordance with this disclosure include gases, liquids, and liquids containing solids. Suitable gases include: hydrogen, carbon dioxide, nitrogen, air, flue gas, natural gas, methane, ethane, and steam. Suitable liquids include: hot water, acids, alcohols, natural gas liquids (propane, butane) or other liquid hydrocarbons, micellar solutions, and polymers. Suitable solids for use in liquids include: proppant, gravel, and sand. In addition, test fluids may include: de-emulsifiers (emulsion breakers), asphaltene stabilizing agents, microbial solutions, surfactants, solvents, viscosity modifiers, and catalysts.

Detectable reactions between test fluids and fluid samples include: the formation of solid particles (e.g. asphaltene, waxes, or precipitates), the formation of emulsions, a change in viscosity of the fluid sample, the generation of a gas, the generation of heat, or the change of any other thermophysical property of the fluid sample (e.g. density, phase envelope, etc.).

The reaction between the test fluid and the fluid sample is detected and measured over time using one or more sensors. The sensors may be located inside and/or outside (e.g., an X-ray sensor or gamma-ray sensor) the mixing chamber. They may be located along flowlines in the tool. In cases where the reaction is detected in the formation, the sensors may be located on or near the exterior of the tool body.

Useful sensors include sensors that can measure, among other things, one or more of density, pressure, temperature, viscosity, composition, phase boundary, resistivity, dielectric properties, nuclear magnetic resonance, neutron scattering, gas or liquid chromatography, optical spectroscopy, optical scattering, optical image analysis, scattering of acoustic energy, neutron thermal decay or neutron scattering, conductance, capacitance, carbon/oxygen content, hydraulic fracture growth or propagation, radioactive and non-radioactive markers, bacterial activity, streaming potential generated during injection, $H_2S$, trace elements, and heavy metals.

The downhole tool of this disclosure can be deployed with a wireline, a tractor, or coiled tubing in an open or cased hole. Alternatively, it can be deployed as part of a logging while drilling (LWD) tester that can be incorporated in a drill string and used while drilling.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
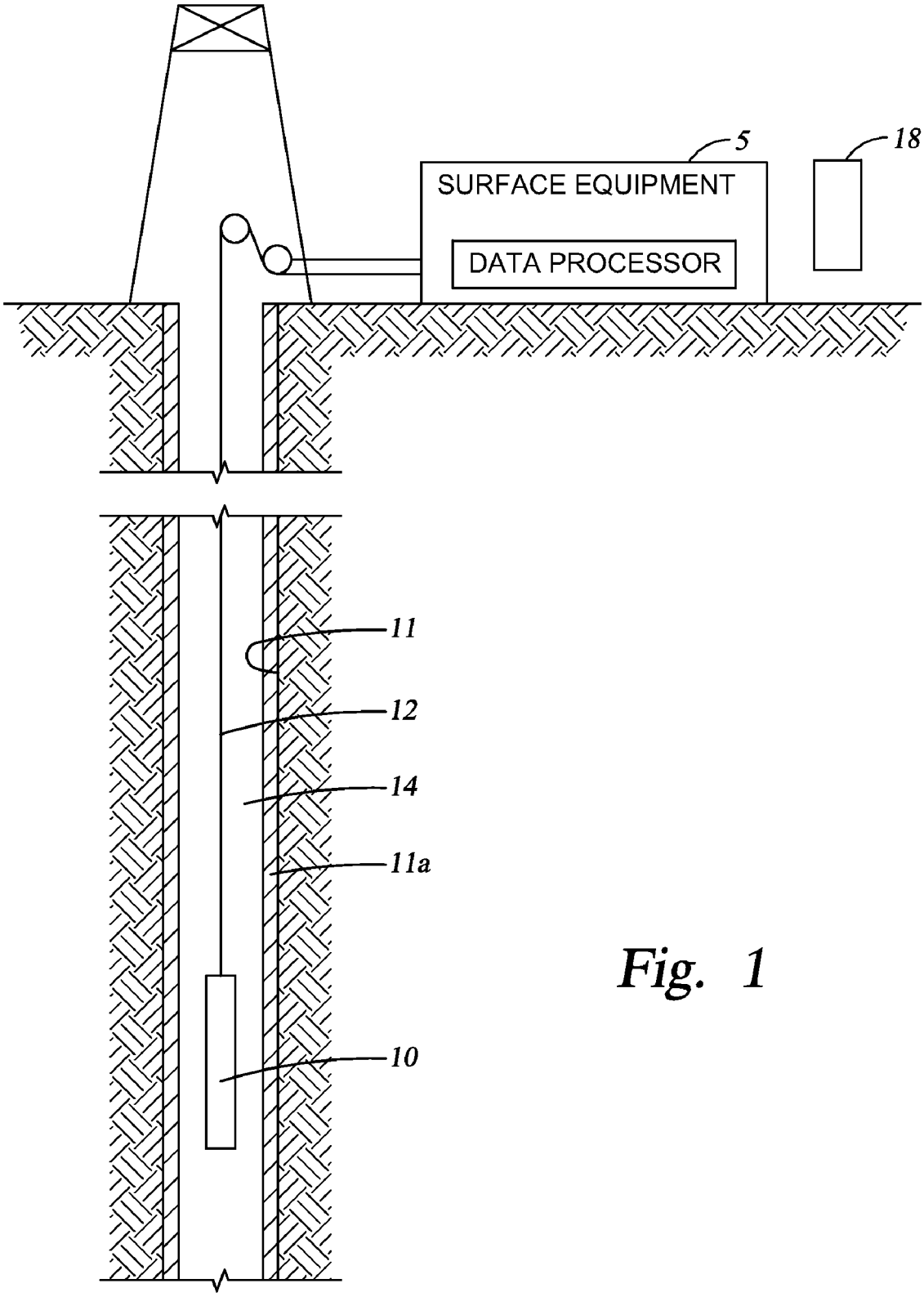
FIG. 1 is a schematic representation of system in accordance with this disclosure deployed via wire line in a wellbore and coupled to surface equipment.

Turning now to FIG. 1, the basics of a reservoir exploration (borehole logging) system are shown. A borehole tool or sonde 10 is shown suspended in a borehole 14 of a formation 11 by a cable 12, although it could be located at the end of coil tubing, coupled to a drill pipe, or deployed using any other means used in the industry for deploying exploration tools. The wall of the borehole 14 is usually lined with a mudcake 11*a* that may assist testing of the reservoir formation with the tool or sonde 10. Cable 12 not only physically supports the borehole tool 10, but typically, signals are sent via the cable 12 from the borehole tool 10 to surface located equipment 5. Electrical power may be provided to the tool via the cable 12 as well. The surface located equipment 5 may include a signal processor, a computer, dedicated circuitry, or the like which is well known in the art. Typically, the equipment/signal processor 5 takes the information sent uphole by the borehole logging system 10, processes the information, and generates a suitable record such as a display log 18 or the like. Suitably, the information may also be displayed on a screen and recorded on a data storage medium or the like.

Figure 2A:
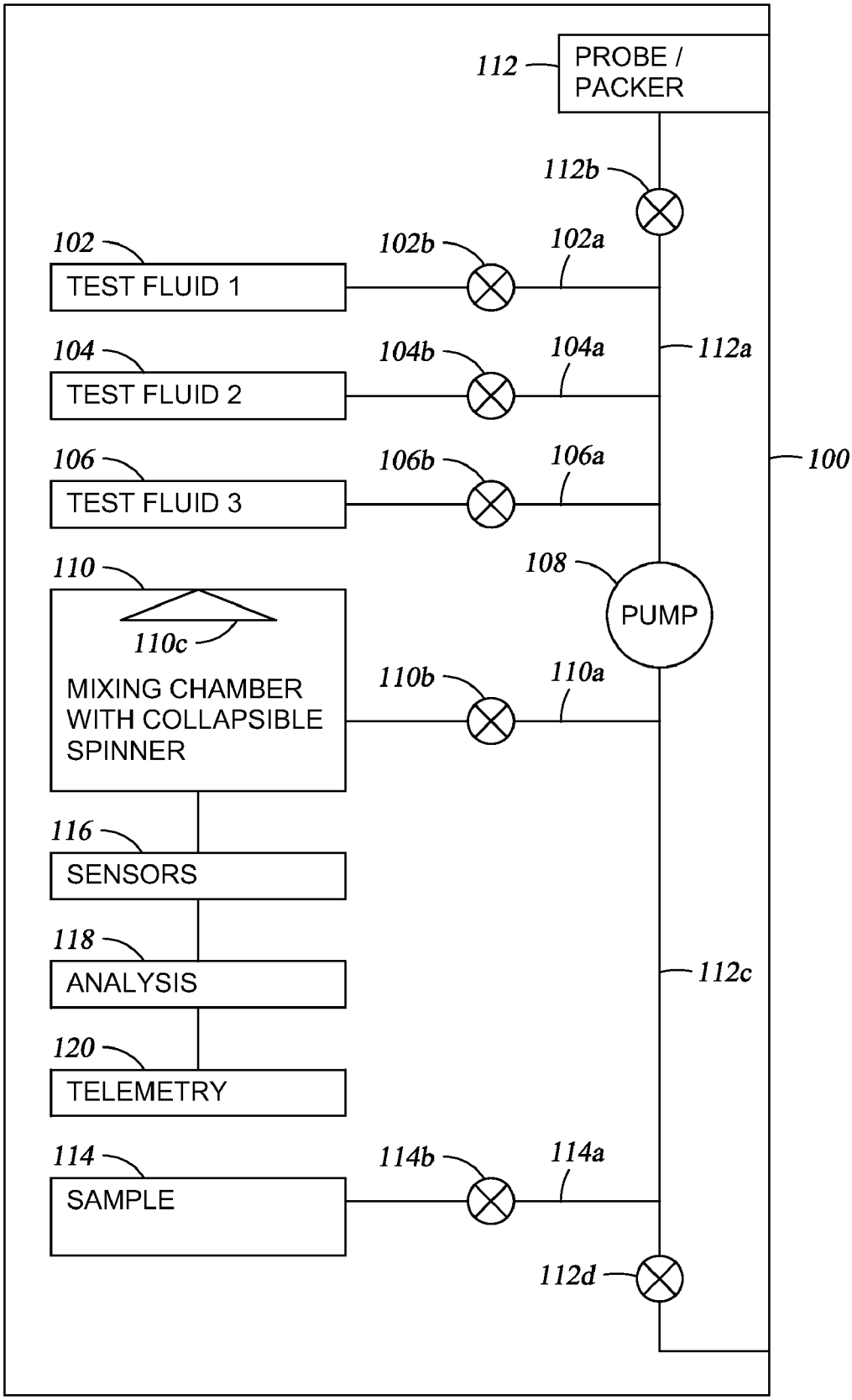
FIG. 2A is a schematic diagram of the components of a first embodiment of a system in accordance with this disclosure.

A first embodiment of a system or tool in accordance with this disclosure is illustrated schematically in FIG. 2A. The system or tool 100 includes a plurality of test fluid chambers, e.g. chambers 102, 104, 106, a reversible pump 108, a mixing chamber 110, and a probe or packer 112. The chambers 102, 104, 106, 110 and the probe or packer 112 are selectively coupled to the pump 108 via conduits 102*a*, 104*a*, 106*a*, 110*a*, 112*a* and valves 102*b*, 104*b*, 106*b*, 110*b*, 112*b*. The pump 108 is further selectively coupled to the wellbore via conduit 112*c* and valve 112*d*. Optionally, one or more sample chambers 114 (one shown) is/are selectively coupled to the pump 108 via one or more conduits 114*a* (one shown) and one or more valves 114*b* (one shown). According to this embodiment one or more sensors 116 are associated with the mixing chamber 110 and the mixing chamber 110 is provided with a mixing device such as a spinner 110*c*. The one or more sensors 116 may be inside the mixing chamber 110 and/or simply near it depending on what type of sensors are used. For example, pressure and temperature sensors are preferably located inside the mixing chamber or at least in fluid communication with the mixing chamber. X-ray and sonic sensors can be located outside the chamber. If the chamber is clear or is provided with windows, optical spectroscopy sensors can be located outside the chamber. The sensors 116 are preferably coupled to a circuit or circuits 118 which process, preprocess or otherwise analyze the sensor outputs. The processed sensor output is preferably conveyed to surface equipment via a telemetry unit 120 coupled to the analysis circuits 118. When possible, the telemetry 120 is bidirectional and receives commands from the surface equipment to operate the valves, the pump, and the injector/extractor. Though not shown in the Figures, it will be appreciated that the remotely controlled components are coupled to the telemetry. It should be appreciated that the tool could operate autonomously using a downhole controller executing software instructions.

In one example, the chambers 102, 104, 106, 110 and 114 if applicable, are equipped with a sliding piston capable of reciprocating in the chamber. The piston may define one side of the chamber in fluid communication with the wellbore. Thus, fluids located on the other side of the chambers are maintained at wellbore pressure.

In one example, the probe or packer 112 is an extendable probe. Probe 112 may be selectively recessed below the outer surface of the tool, or extended into sealing engagement with the wellbore wall. In the extended position, the extendable probe 112 establishes a fluid communication between the tool and the formation. The extendable probe 112 may alternatively be in fluid communication with the wellbore in the retracted position. Alternatively, the probe or packer 112 may be an inflatable straddle packer, and provide a function similar but not identical to an extendable probe.

In another example, the probe or packer 112 isolates a guard zone and a sample zone on the borehole wall (11 in FIG. 1). Usually, the guard zone surrounds the sample zone. Fluid drawn from the guard zone by a pump (not shown) may be disposed in the wellbore (not shown). Fluid drawn simultaneously from the sample zone by the pump 108 may be used for the compatibility testing. This arrangement eventually provides a formation fluid substantially free of mud filtrate or other wellbore fluid. In this arrangement, the compatibility testing performed on the fluid drawn from the sample zone may be essentially identical to the compatibility testing performed on pristine formation fluid. In yet another example where the wellbore is cased with a casing, the probe or packer includes a mechanism for perforating the casing, such as a drilling mechanism, and a mechanism for plugging the casing after testing.

In another example, the pressure and/or the temperature in the mixing chamber 110 may be adjusted and the sensors 116 may detect a reaction occurring in the mixing chamber at various pressures and/or temperatures.

Figure 2B:
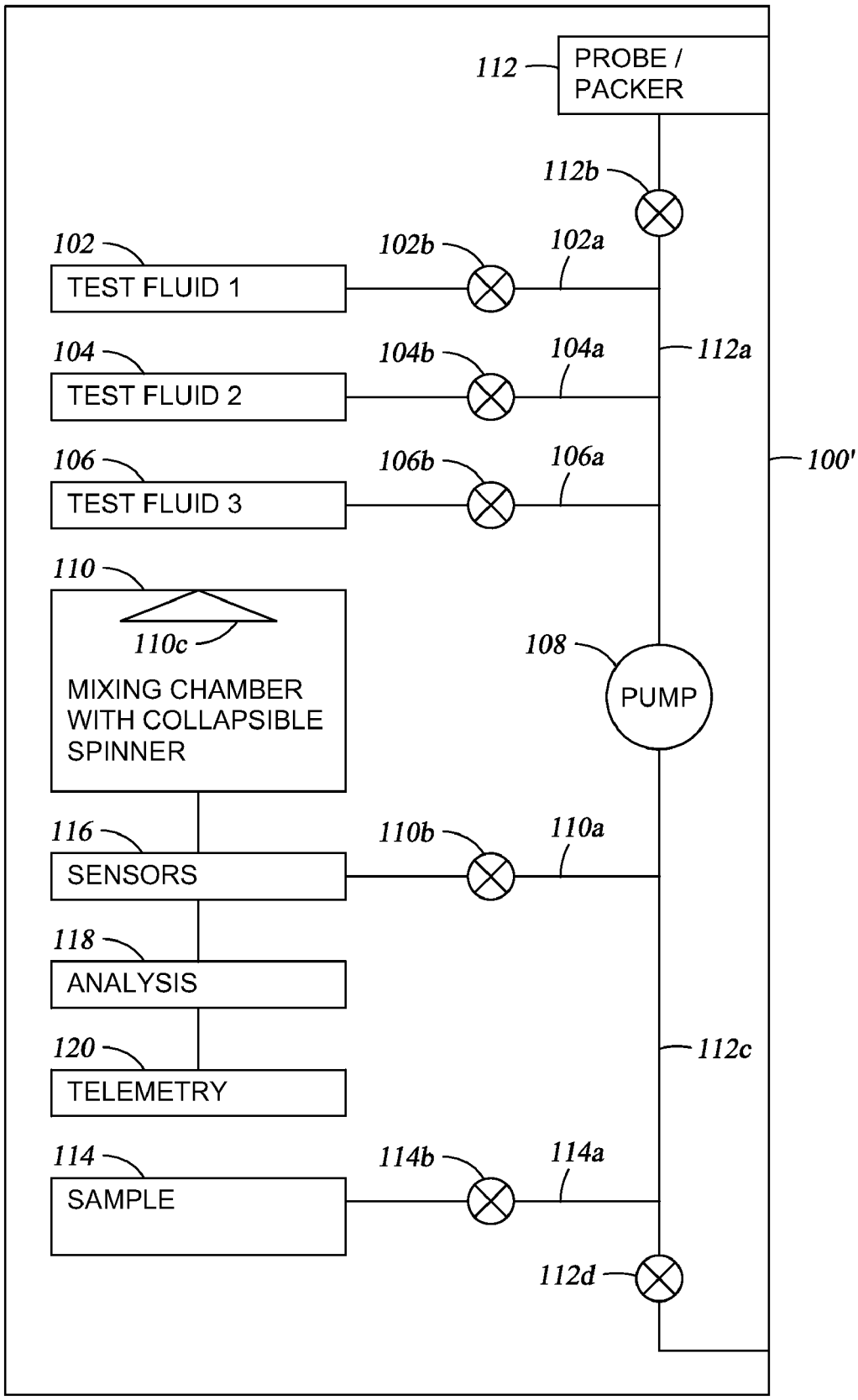
FIG. 2B is a schematic diagram of the components of a variation of the embodiment shown in FIG. 2A.

FIG. 2B illustrates a tool 100' in accordance with this disclosure. The components of the tool 100' are nearly identical to those of the tool 100. The similar components have the same reference numerals. The difference in this embodiment is that the sensors 116' are located in or adjacent to a flowline such as the conduit 110*a* which couples the mixing chamber 110 with the pump 108. If desired, sensors can be provided at both locations, i.e., in or adjacent the flowline between the pump and the mixing chamber as well as in or adjacent the mixing chamber.

In the arrangement of FIG. 2B, the sensors 116' may be used to perform measurements on fluids flowing from the probe or packer 112 prior to mixing with test fluids in the mixing chamber 110. For example, the sensors 116' may be used to perform measurements on wellbore or formation fluids. The sensors 116' may also be used to perform measurements on fluids flowing from test fluid chambers 102, 104 or 106 prior to mixing with another fluid in the mixing chamber 110.

The sensors 116' may further be used to perform measurements on fluid mixtures flowing from the mixing chamber 110. In one example, a sampled formation fluid and a test fluid react with each other in the mixing chamber and the product of the reaction is a solid or a gas. The produced solid or gas may segregate by gravity from other materials in the mixing chamber. The conduit 110*a* is connected for example to the bottom of the mixing chamber 110. When materials are flowed from the mixing chamber through the sensor 116' and the conduit 110*a* is connected to the bottom of the mixing chamber 110, the sensor 116' perform measurements on materials with decreasing densities as the mixing chamber 110 is emptied, thus facilitating in some cases the detection of the reaction that occurred in the mixing chamber 110.

Figure 3:
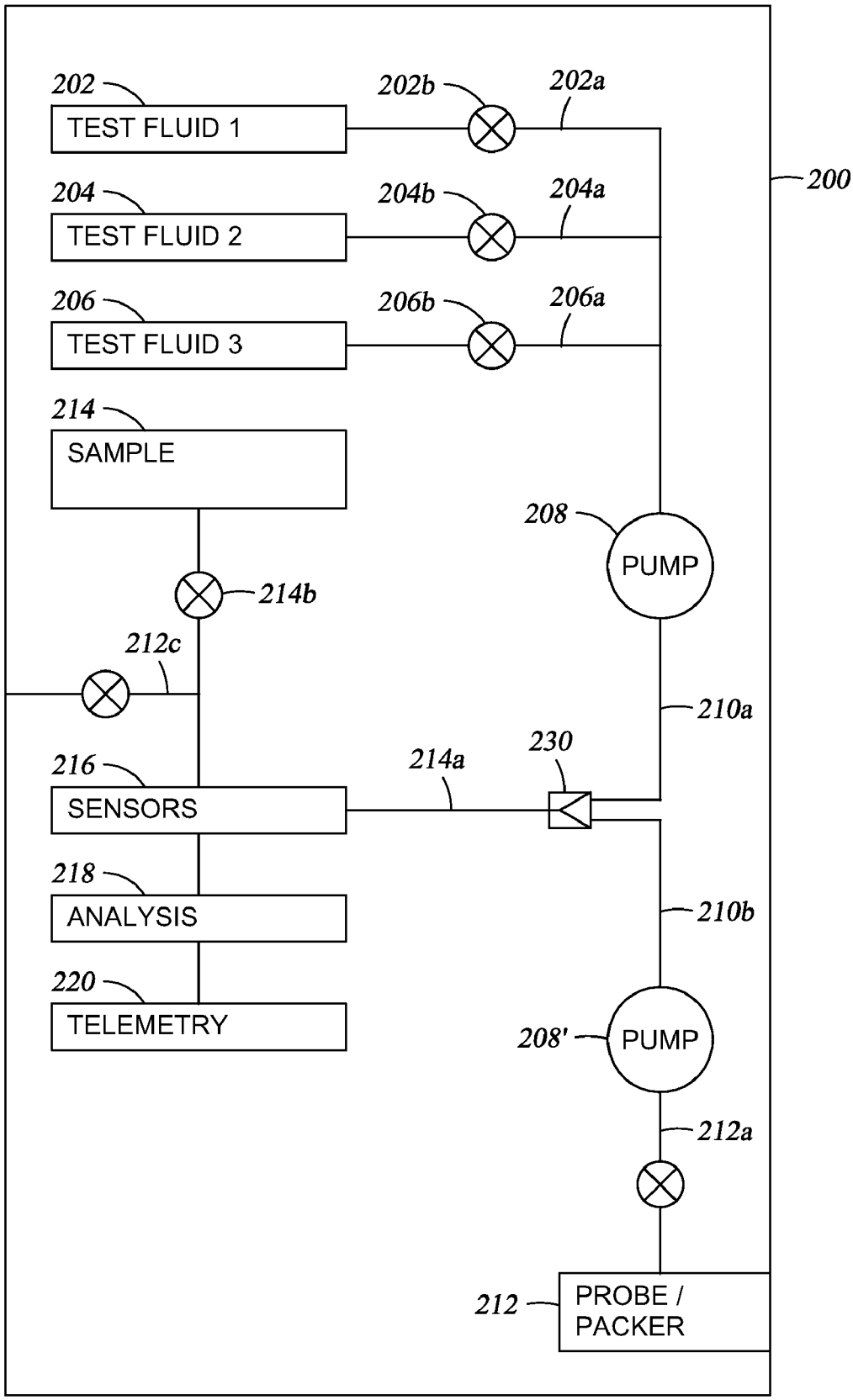
FIG. 3 is a schematic diagram of the components of a second embodiment of a system in accordance with this disclosure.

FIG. 3 illustrates a second embodiment of a tool 200 in accordance with this disclosure. The components of the tool 200 are nearly identical to those of the tool 100. The similar components have similar reference numerals increased by one hundred. The difference in this embodiment is that the mixing of one test fluid flowing from one of the chambers 202, 204 or 206 and the fluid flowing from the probe or extendable packer 212 occurs in an inline mixer 230. The inline mixer 230 may be of any types know in the art, capable of mixing fluids flowing from flow lines 210*a* and 210*b*. The mixture may flow then through conduit 212*c* and be dumped into the borehole. The mixture may alternatively flow through conduit 214*a* and be captured in a sample chamber 214.

In the arrangement of FIG. 3, the proportion of the test fluid and the sampled fluid in the mixture may be controlled by the ratio of the pumping rates of pumps 208 and 208'. This proportion can be modified according to the objectives of the compatibility test. The sensor 216 is capable of performing a measurement on the mixture having various proportions of sampled fluid and test fluid. As shown, the sensor 216 is further capable of measuring the fluid coming out of mixer 230. Thus, the information provided by the sensor 216 may be used to advantage to decide when to collect a sample in the chamber 214.

In one example, the function of pump 208 may be combined with the function of chambers 202, 204 and/or 206. For example, a pressure providing apparatus such as a pump (or a valve coupled to the borehole) could be provided in conjunction with each chamber to controllably force fluid out of the chamber. Alternatively, the fluids in the chambers 202, 204, 206 could be kept at high pressure and controllably released for mixture simply by opening a respective associated valve 202*b*, 204*b*, 206*b*.

Figure 4:
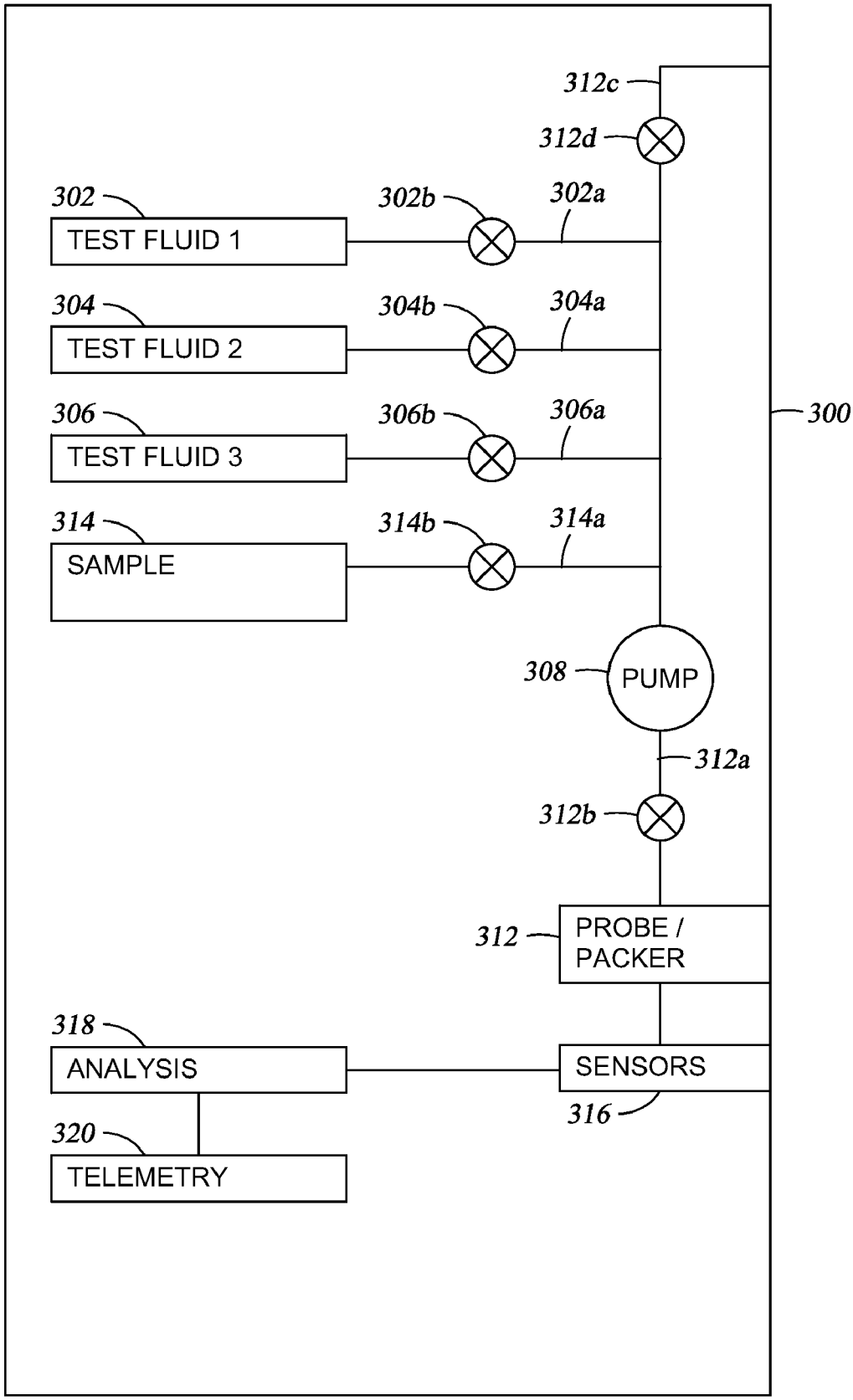
FIG. 4 is a schematic diagram of the components of a third embodiment of a system in accordance with this disclosure.

FIG. 4 illustrates a third embodiment of a tool 300 in accordance with this disclosure. The components of the tool 300 are nearly identical to those of the tool 100. The similar components have similar reference numerals increased by two hundred. The difference in this embodiment is that the sensors 316 are located to sense reactions occurring in the formation as described in more detail below with reference to FIG. 9. Since the reactions will take place in the formation, no mixing chamber is required for mixing the test fluid with a formation fluid. It should be appreciated nevertheless that a mixing chamber may be provided if the test requires injecting a mixture of test fluids that for any reason, is not mixed before the tool is run in the hole.

In the arrangement of FIG. 4, the reaction in the formation is detected by the sensors 316 and analyzed by the circuits 318. The mixture of test fluid and formation fluid may further be extracted from the formation by the probe or packer 312 and captured in a chamber 314 if desired.

The sensors 316 may be located on the body of tool 300 or on the probe or packer 312. These sensors measure characteristics of the mixture of formation fluid and test fluid that is still in the formation. Alternatively or additionally these sensors measure characteristics of the formation rock in the presence of test fluid. Thus the sensors 316 may be used to determine the compatibility of the test fluids carried downhole by the tool 300 with the formation fluid and/or the formation rock.

Some examples of sensors that could be used are sensors that measure multi-depth resistivity properties, dielectric properties, nuclear magnetic resonance (NMR) properties, neutron spectroscopic properties such as thermal decay and carbon/oxygen ratio.

Alternatively or additionally, remote sensors may be deployed in the formation, as shown for example in U.S. Pat. No. 6,766,854, assigned to the assignee of the present invention, and the complete disclosure of which is incorporated herein by reference. Remote sensors may sense a fluid or a formation property. The remote sensors preferably communicate the sensed property to the downhole tool for analysis.

Although only one probe or packer 312 is shown in FIG. 4, a first probe or packer 312 may be used for injecting test fluids and a second probe or packer (not shown) may be used for extracting fluid or fluid mixtures from the formation. The first probe or packer may be similar to or different from the shape, size or type of the second probe or packer. Each probe or packer may have its own dedicated pump. The probe/packer used for extracting fluid and the probe/packer used for injecting test fluid may be disposed with respect to each other in various ways, including having the injection probe/packer surrounding the extracting probe/packer.

Figure 5:
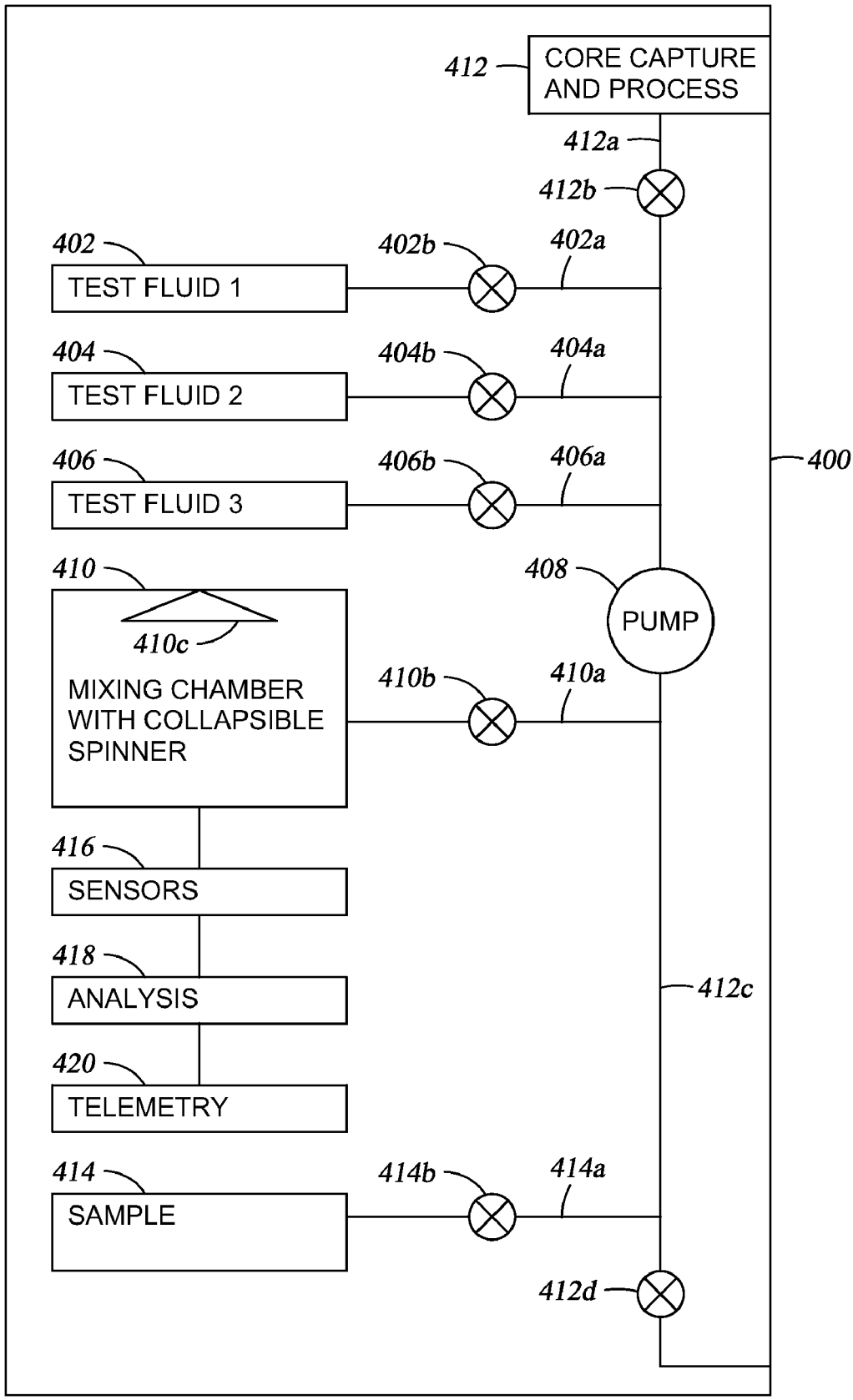
FIG. 5 is a schematic diagram of the components of a fourth embodiment of a system in accordance with this disclosure.

FIG. 5 illustrates a fourth embodiment of a tool 400 in accordance with this disclosure. The components of the tool 400 are nearly identical to those of the tool 100. The similar components have similar reference numerals increased by three hundred. The difference in this embodiment is that the probe/packer 112 (FIG. 2) has been replaced with a core capture and process apparatus 412 for obtaining formation samples as described in more detail below with reference to FIG. 12.

Figure 6:
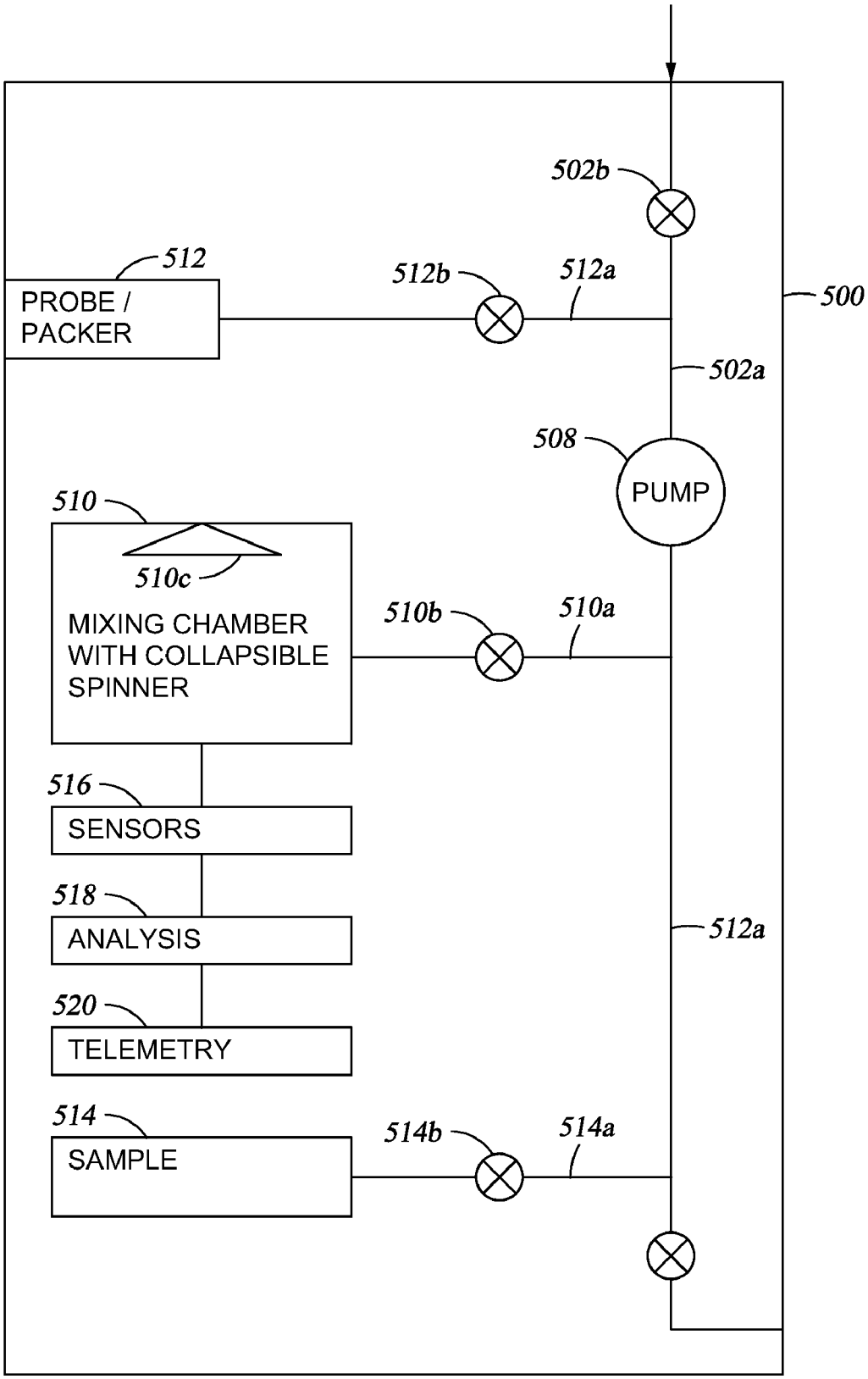
FIG. 6 is a schematic diagram of the components of a fifth embodiment of a system in accordance with this disclosure.

FIG. 6 illustrates a fifth embodiment of a tool 500 in accordance with this disclosure. The components of the tool 500 are similar to those of the tool 100. The similar components have similar reference numerals increased by four hundred. The difference in this embodiment is that the test fluid chambers and their associated valves and conduits have been replaced with a conduit 502*a* and a valve 502*b* which are arranged to receive test fluid from the surface while the tool 500 is downhole as described in more detail below with reference to FIG. 10.

Figure 7:
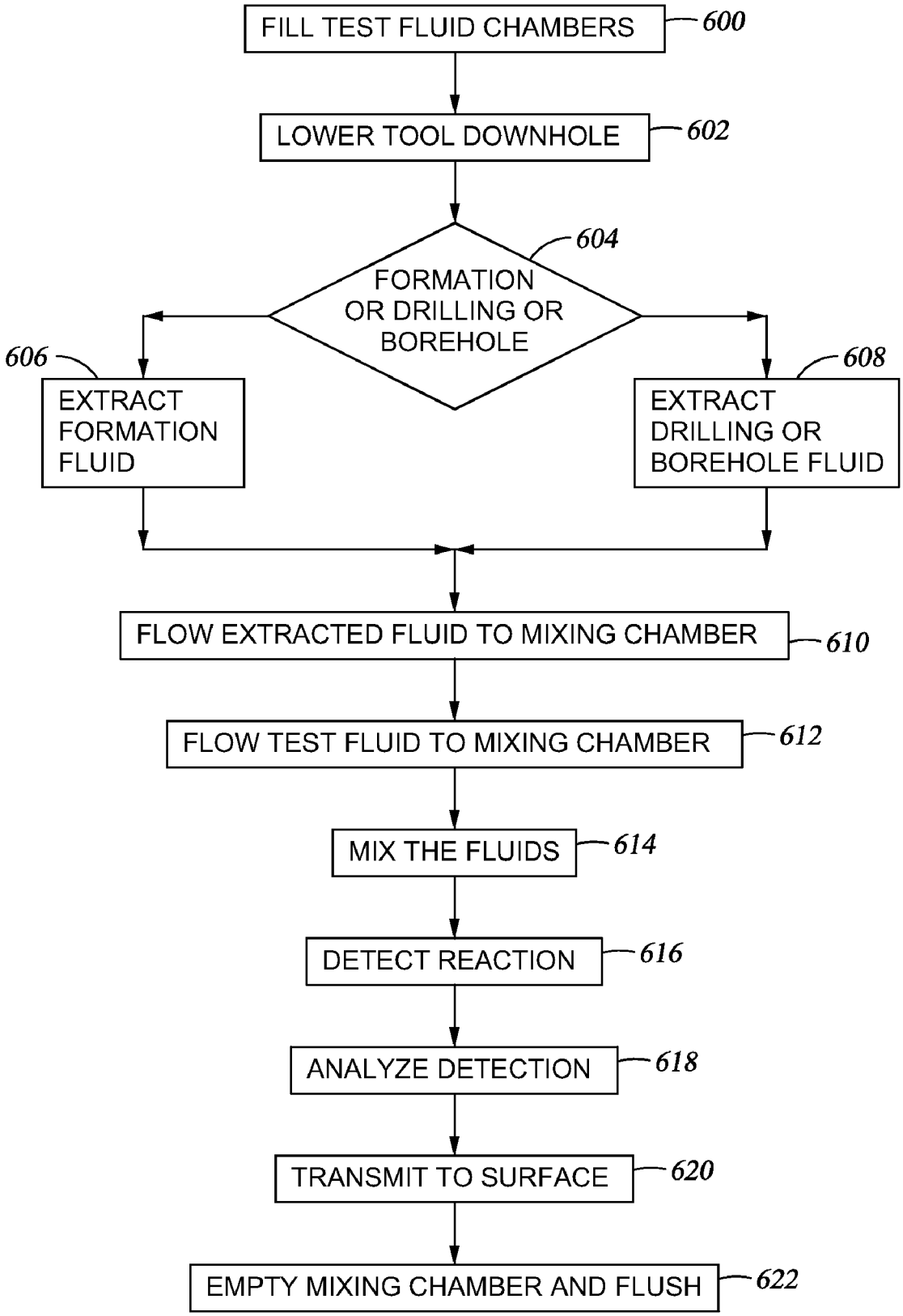
FIG. 7 is a flow chart of a first embodiment of a method in accordance with this disclosure.

FIG. 7 is a flow chart of a first embodiment of a method in accordance with this disclosure which can be performed with the tools 100, 100', or 400. Referring now to FIGS. 2A and 7, the method begins at 600 by filling the test fluid chambers 102, 104, 106 of tool 100. The tool 100 is then lowered downhole at 602. An option is selected at 604 to extract formation fluid, borehole fluid or drilling fluid if applicable. If formation fluid is to be extracted at 606, the probe or packer 112 is extended into contact with the formation. If drilling fluid is to be extracted at 608, the probe or packer 112 is not extended beyond the drilling fluid. In either case, the fluid is extracted by opening the valves 112*b* and operating the pump 108. When desired, the valve 110*b* may be opened. This causes the extracted fluid to flow to the mixing chamber 110 at 610. When sufficient sample fluid has filled the mixing chamber, the pump is stopped and the valve 112*b* is closed. Test fluid is sent to the mixing chamber at 612 by opening one or more of the valves 102*b*, 104*b*, 106*b* and operating the pump. When sufficient test fluid has been sent to the mixing chamber 110, the pump is stopped and all of the valves are closed. The fluids are mixed at 614 by operating the spinner 110*c*. A reaction of the fluids with each other is detected at 616 using sensors 116. The sensor output is analyzed at 618 using the analysis circuits 118. The results of analysis are transmitted to the surface at 620 using the telemetry equipment 120. Preferably, the mixing chamber 110 is emptied and flushed at 622. The mixing chamber can be emptied by opening valve 110*b*, and one of valves 112*b*, 114*b* or 112*d* and operating the pump 108 to transfer the contents to back into the formation, into the container 114 or into the wellbore. The contents of mixing chamber 112 may be alternatively transferred into one of the preferably empty chambers 102, 104, 106 if desired. If one of the test fluid chambers 102, 104, 106 is filled with a non-reactive fluid, it can be used to flush the mixing chamber before performing the next test.

Figure 8:
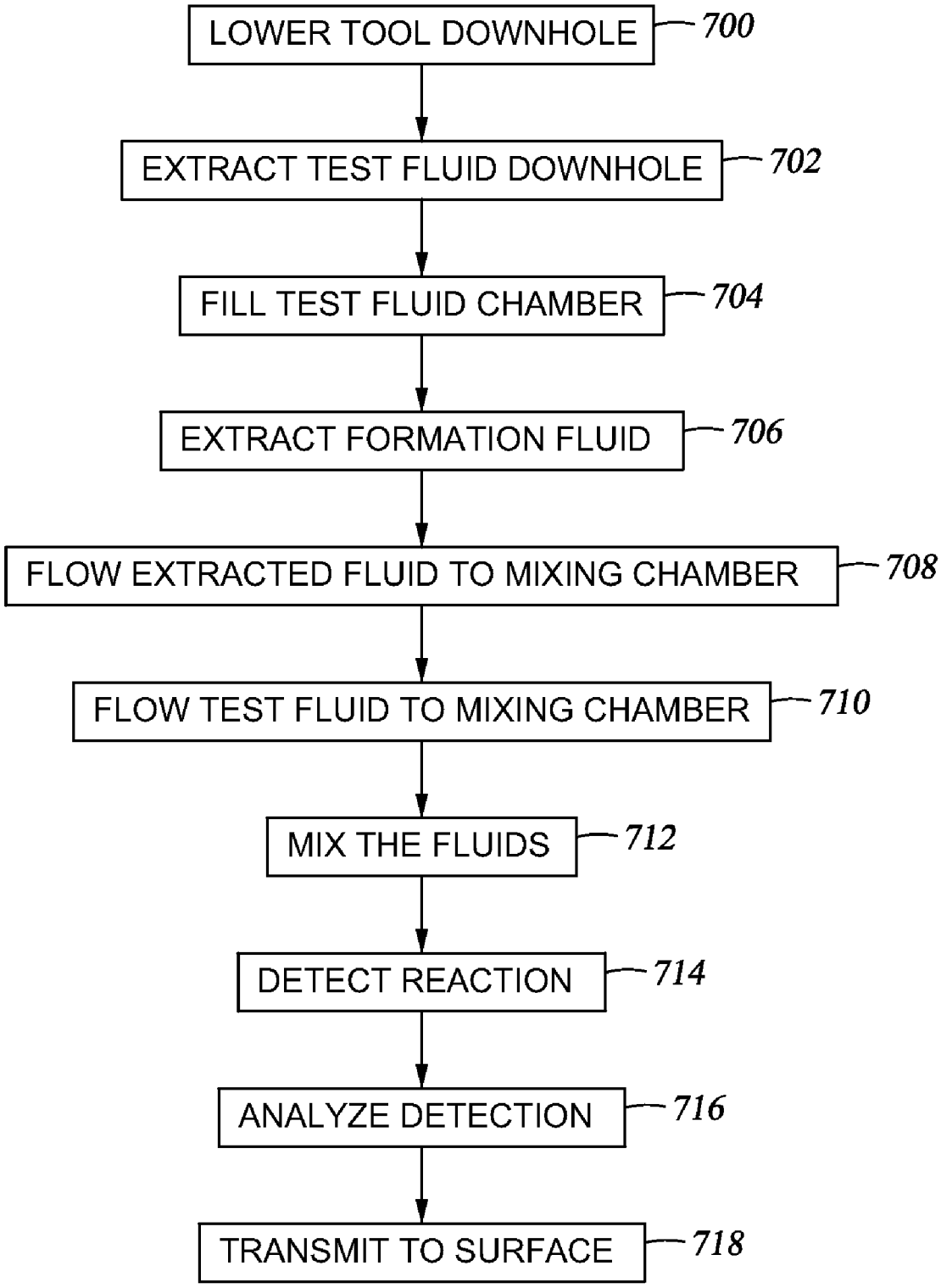
FIG. 8 is a flow chart of a second embodiment of a method in accordance with this disclosure.

FIG. 8 is a flow chart of a second embodiment of a method in accordance with this disclosure which can be performed with the tools 100, 100', or 400. Referring now to FIGS. 2A and 8, the method begins at 700 by lowering the tool downhole with at least one test fluid chamber 102, 104, 106 empty, e.g., 102. A test fluid is extracted downhole at 702 by opening the valves 112*b* and 114*b*, and operating the pump 108 to collect downhole fluid into the sample chamber 114. The test fluid may then be transferred into the chamber 102 at 704 by closing valve 112*b*, opening valve 102*b* and reversing the pump 108. The fluid collected might be drilling fluid or formation fluid. Formation fluid is then extracted at 706 in the same manner as described above with reference to FIG. 7. The tool might be moved to a different depth between the steps 704 and 706. The fluid extracted at 706 can be pumped directly into the mixing chamber at 708. The collected test fluid stored in chamber 102 is then added to the mixing chamber at 710. The fluids are mixed at 712 and their reaction is detected at 714. The reaction is analyzed at 716 and the results transmitted to the surface at 718.

Figure 9:
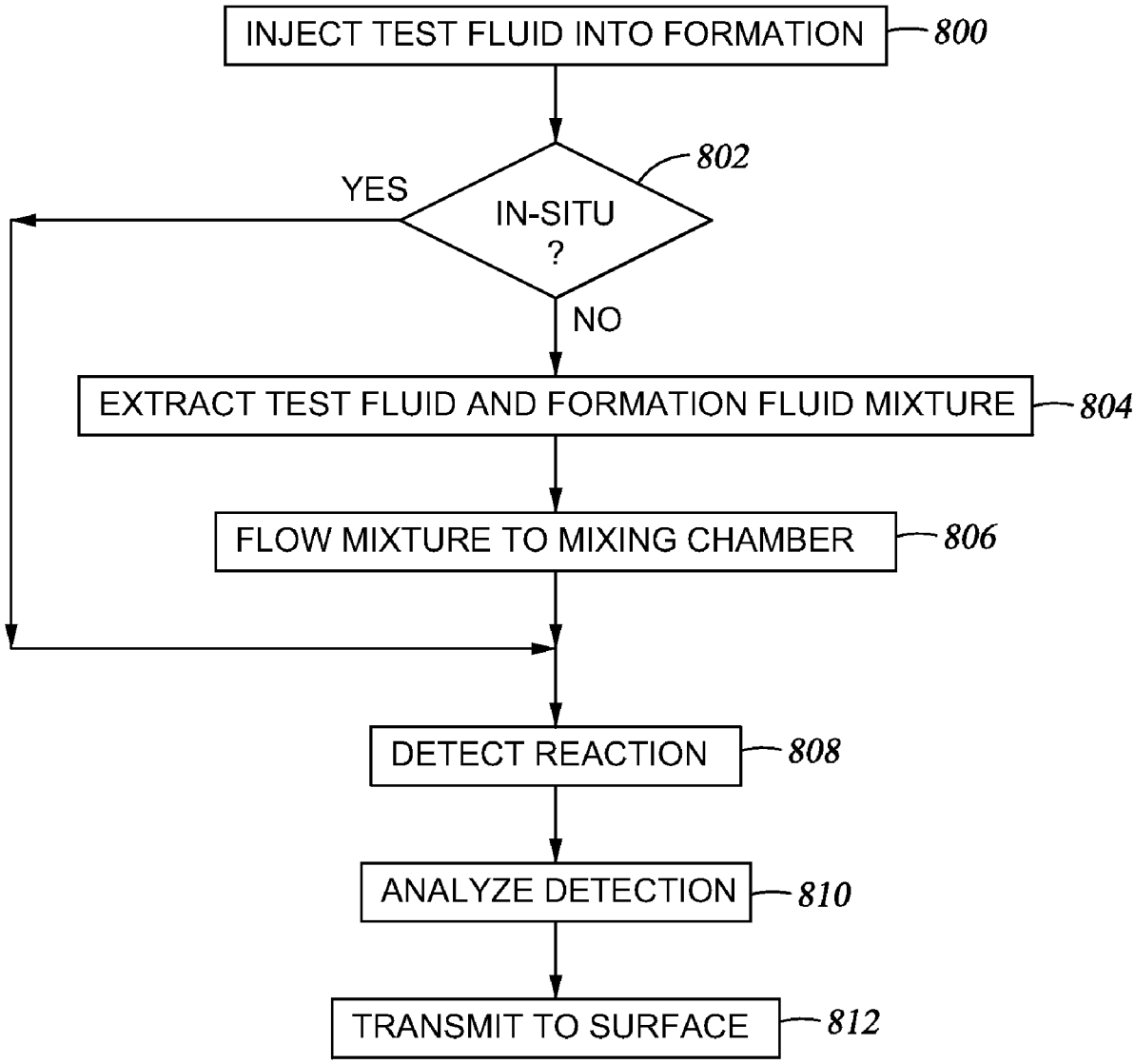
FIG. 9 is a flow chart of a third embodiment of a method in accordance with this disclosure.

FIG. 9 is a flow chart of a third embodiment of a method in accordance with this disclosure which, depending on the choice made at 802 can be performed with one of the tools 100 and 100' or with the tool 300. According to this embodiment, test fluid is injected into the formation at 800. The injection rate and injection pressure may be recorded and analyzed as described in detail below.

If one of the tool 100 and 100' is utilized for the test, a test fluid of one of the chamber 102, 104 or 106 may be transferred into chamber 110 using the pump 108. The test fluid may then be injected into the formation using the probe or packer 112. Alternatively, a mixture of test fluid and sample fluid can be collected at the same or different depth, for example in chamber 110 or 102. The mixture may be utilized at 800 as a test fluid. If the tool 300 is utilized for the test, any test fluid from chamber 302, 304 and 306 can be injected into the formation using the probe or packer 312 of the tool 300.

If the test is to be performed in-situ as determined at 802, the tool 300 is preferably used and the in-situ reaction is detected at 808 using the sensors 316 (FIG. 4). If the determination at 802 is to perform the test in the mixing chamber 110, (FIG. 2A or FIG. 2B) the combined test fluid and formation fluid are extracted at 804 and sent to the mixing chamber at 806 and their reaction is detected by the sensor(s) 116 or 116' (FIG. 2A or FIG. 2B). In either case, the output of the sensors is analyzed at 810 and the analysis transmitted to the surface at 812. It will be appreciated that in the example given, the decision at 802 must be made before the tool is lowered downhole. Alternatively, the tool 300 could be modified to include a mixing chamber and two sets of sensors, one set arranged to detect in-situ reactions and another to detect reactions in the mixing chamber.

Injection rate and injection pressure may be correlated. Their relationship may be used to identify permeability damage due to the mixing of the test fluid and the formation fluid in the reservoir. Alternatively, a mixture exhibiting a reaction may be utilized as injection fluid. The relationship between injection rate and injection pressure may be utilized to assess the impact of this reaction on the permeability or mobility of in the formation in which the mixture is injected.

The method of FIG. 9 may be used in combination for example with the method of FIG. 7. The method of FIG. 7 is applied first and the compatibility between the test fluid and the sample fluid is determined. In some cases, the fluids may be compatible. The method of FIG. 9 is then performed with the same test fluid being introduced into the formation. Knowing that the fluids are compatible, if an incompatibility in the formation occurs, an incompatibility between the test fluid and formation rock can be suspected.

Figure 10:
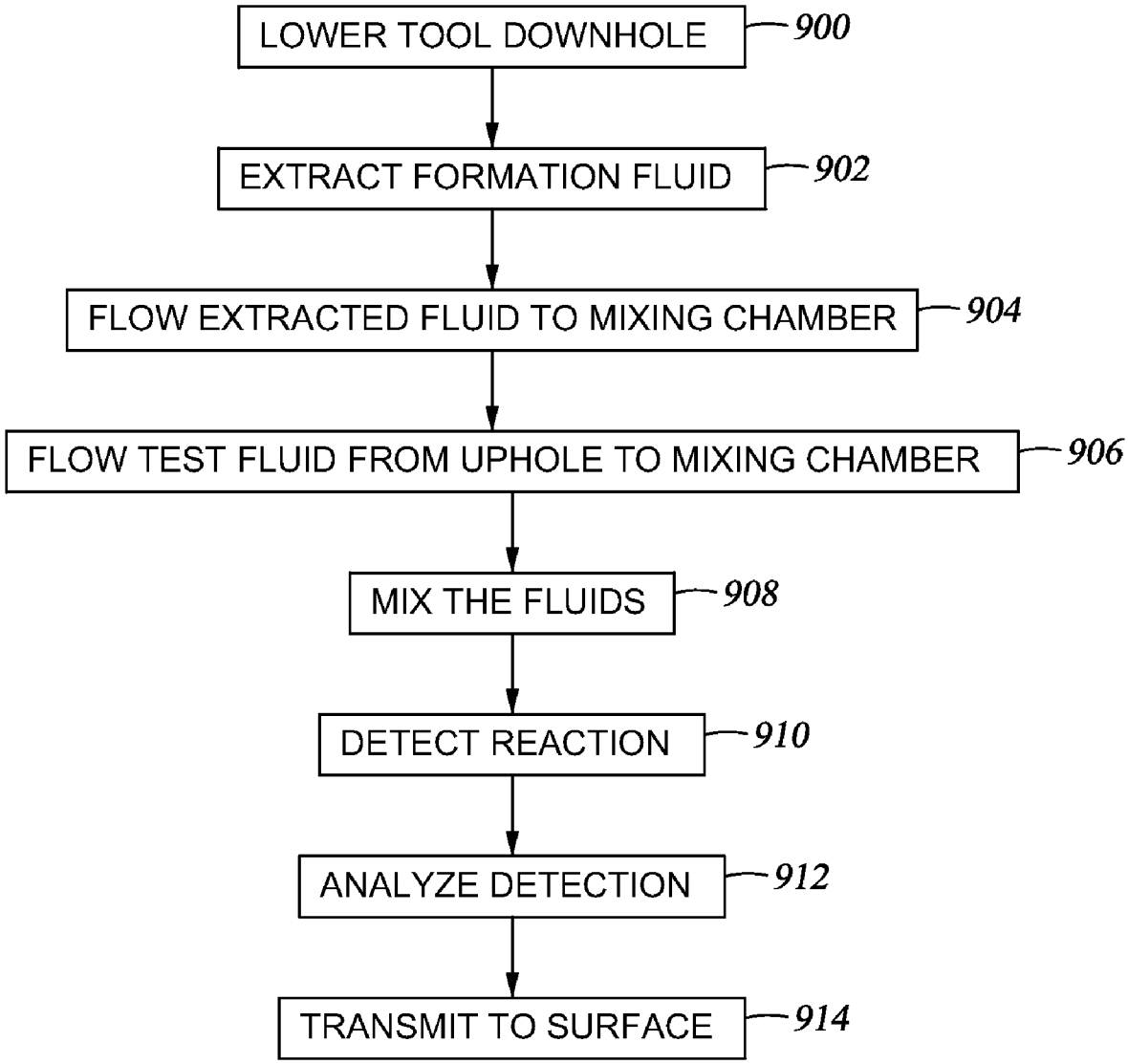
FIG. 10 is a flow chart of a fourth embodiment of a method in accordance with this disclosure.

FIG. 10 is a flow chart of a fourth embodiment of a method in accordance with this disclosure which can be performed with the tool 500 (FIG. 6). Referring now to FIGS. 6 and 10, the tool 500 is lowered downhole at 900. Using the probe or packer 512, the pump 508, associated valves and conduits, formation or drilling fluid is extracted at 902 and sent to the mixing chamber 510 at 904. Using the pump 508, conduit 502*a* and valve 502*b*, test fluid from uphole is sent to the mixing chamber 510 at 906. The fluids are mixed at 908 and a reaction is detected at 910. The output of sensors 516 is analyzed at 912 using the circuits 518 and the results of analysis are transmitted to the surface at 914 using the telemetry equipment 520. It will be appreciated that test fluid from the surface could be delivered to the mixing chamber by gravity or surface pumps. In that case, the conduit 502*a* would be coupled directly to the mixing chamber.

Figure 11:
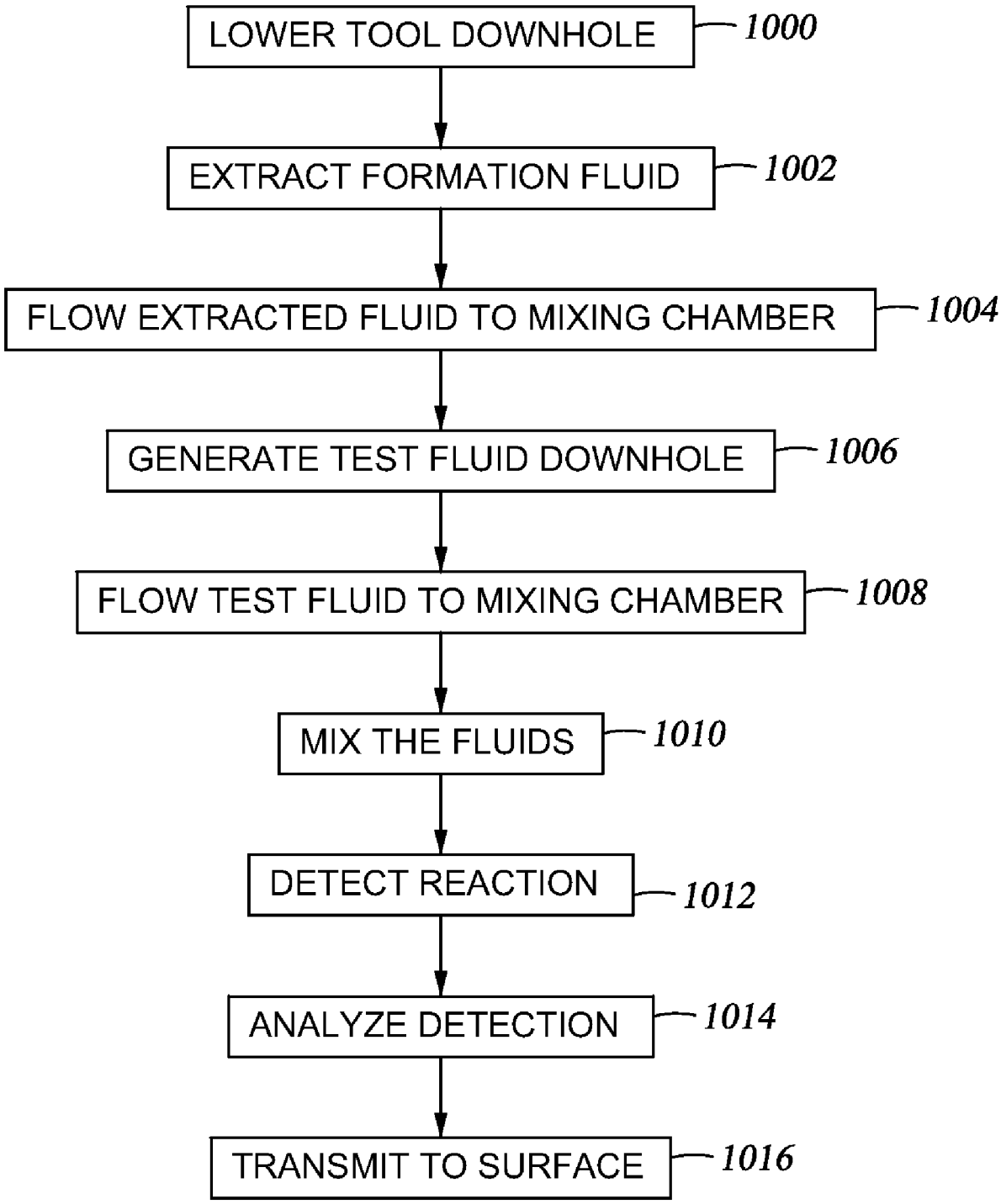
FIG. 11 is a flow chart of a fifth embodiment of a method in accordance with this disclosure.

FIG. 11 is a flow chart of a fifth embodiment of a method in accordance with this disclosure which can be performed with the tools 100, 100', 200 or 400. The tool is lowered downhole at 1000. Formation fluid is extracted at 1002 and sent to the mixing chamber at 1004. At 1006, the test fluid is generated, e.g. by heating water to create steam, or by mixing two or more reactants together. When the reactants include a solid and a liquid, the liquid reactant can be pumped into the chamber containing the solid reactant, and the resulting test fluid may be sent to the mixing chamber at 1008. When the reactants include two liquids, it is preferable to mix them prior to contacting the formation fluid. Thus, they are preferably introduced into the mixing chamber prior to sending the formation fluid into the chamber. Regardless, the test and formation fluids are mixed at 1010 and a reaction is detected at 1012. The sensor output is analyzed at 1014 and the results of analysis are transmitted to the surface at 1016.

Figure 12:
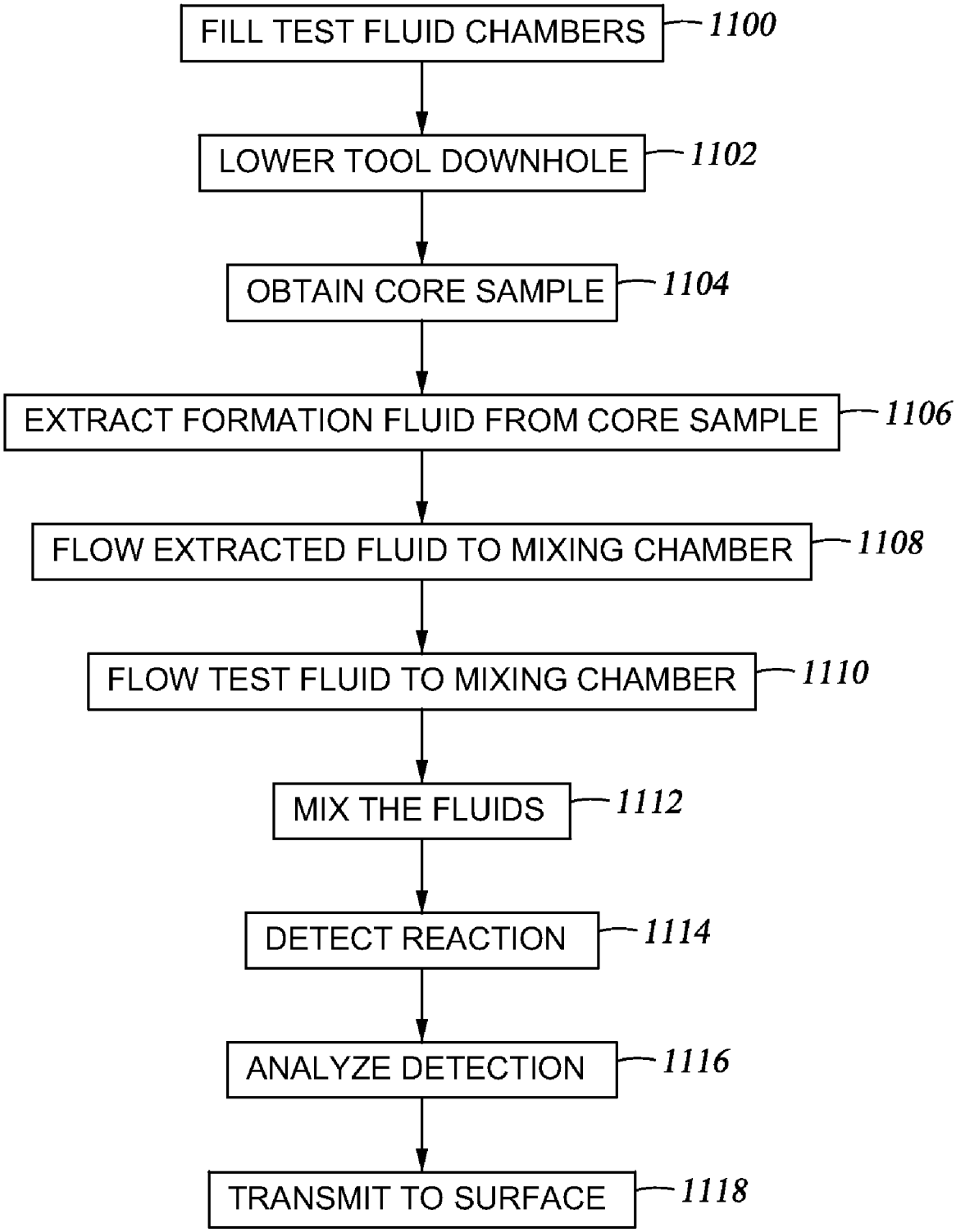
FIG. 12 is a flow chart of a sixth embodiment of a method in accordance with this disclosure.

FIG. 12 is a flow chart of a sixth embodiment of a method in accordance with this disclosure which can be performed with the tool 400. Referring now to FIGS. 5 and 12, the method begins at 1100 by filling the test fluid chambers 402, 404, 406. The tool 400 is then lowered downhole at 1102. A core sample is obtained at 1104 using the core capture and process module 412 which captures the core and extracts formation fluid from it at 1106. The extracted fluid is sent to the mixing chamber 410 by opening the valves 410*b* and 412*b* and operating the pump 408. This causes the extracted fluid to flow to the mixing chamber 410 at 1108. When sufficient sample fluid has filled the mixing chamber, the pump is stopped and the valve 412*b* is closed. Test fluid is sent to the mixing chamber at 1110 by opening one or more of the valves 402*b*, 404*b*, 406*b* and operating the pump. When sufficient test fluid has been sent to the mixing chamber 410, the pump is stopped and all of the valves are closed. The fluids are mixed at 1112 by operating the spinner 410*c*. A reaction of the fluids with each other is detected at 1114 using sensors 416. The sensor output is analyzed at 1116 using the analysis circuits 418. The results of analysis are transmitted to the surface at 1118 using the telemetry equipment 420.

Test fluids suitable for use with this disclosure include gases, liquids, and liquids containing solids. Suitable gases include among others: hydrogen, carbon dioxide, nitrogen, air, flue gas, natural gas, methane, ethane, and steam. Suitable liquids include: hot water, acids, alcohols, natural gas liquids (propane, butane), micellar solutions, and polymers. Suitable solids for use in liquids include: proppant, gravel, and sand. In addition, test fluids may include among others: de-emulsifiers (emulsion breakers), asphaltene stabilizing agents, microbial solutions, surfactants, solvents, viscosity modifiers, and catalysts.

Detectable reactions between test fluids and fluid samples include among others: the formation of solid particles (e.g. asphaltene, waxes, or precipitates), the formation of emulsions, a change in viscosity of the fluid sample, the generation of a gas, the generation of heat, or the change of any other thermophysical property of the fluid sample e.g. density, viscosity, compressibility. Also, phase envelope may be estimated from downhole measurements as shown for example in US Patent Application 2004/0104341.

The reaction between the test fluid and the fluid sample is detected and measured over time using one or more sensors. The sensors may be inside or outside (e.g., an X-ray sensor) the mixing chamber. They may be located along flowlines in the tool. In cases where the reaction is detected in the formation, the sensors may be located on or near the exterior of the tool body.

Useful sensors include sensors that can measure among other things one or more of density, pressure, temperature, viscosity, composition, phase boundary, resistivity, dielectric properties, nuclear magnetic resonance, neutron scattering, gas or liquid chromatography, optical spectroscopy, optical scattering, optical image analysis, scattering of acoustic energy, neutron thermal decay, conductance, capacitance, carbon/oxygen content, hydraulic fracture growth, radioactive and non-radioactive markers, bacterial activity, streaming potential generated during injection, $H_2S$, trace elements, and heavy metal.

The downhole tool of this disclosure can be deployed with a wireline, a tractor, or coiled tubing in an open or cased hole. Alternatively, it can be deployed as part of a logging while drilling (LWD) tester that can be incorporated in a drill string and used while drilling.

The downhole tool of this disclosure may send different information depending on the telemetry bandwidth available with its mode of deployment or conveyance. If deployed with a wireline, the downhole tool will benefit from a large telemetry bandwidth. Digitized sensor data may be sent uphole for processing by surface equipment 5 of FIG. 1. If deployed on a drillstring equipped with mud pulse telemetry, the downhole tool may be attributed a very low telemetry bandwidth. Digitized sensor data may be stored in downhole memory for retrieval when the tool is back to surface. The retrieved data may be utilized at the well site or at other locations. The sensor data may be also processed downhole and processing results may be sent uphole, essentially in real time. The results are optionally sent with related confidence indicators.

Whether obtained with a surface data processor or with a downhole data processor, processing results may comprise a flag indicating whether a reaction has been detected or not. A further refinement includes varying the proportions of the test fluid and the sampled fluid in the mixture, and sending the proportions at which the reaction is detected (if applicable). Yet another refinement includes varying the pressure and/or the temperature of the mixture, and identifying the pressure and/or the temperature at which a reaction is detected (if applicable). If more than one sensor is used for detecting a reaction the information from these sensors can be combined and could be used for indicating the type of reaction that has been detected.

Figure 13:
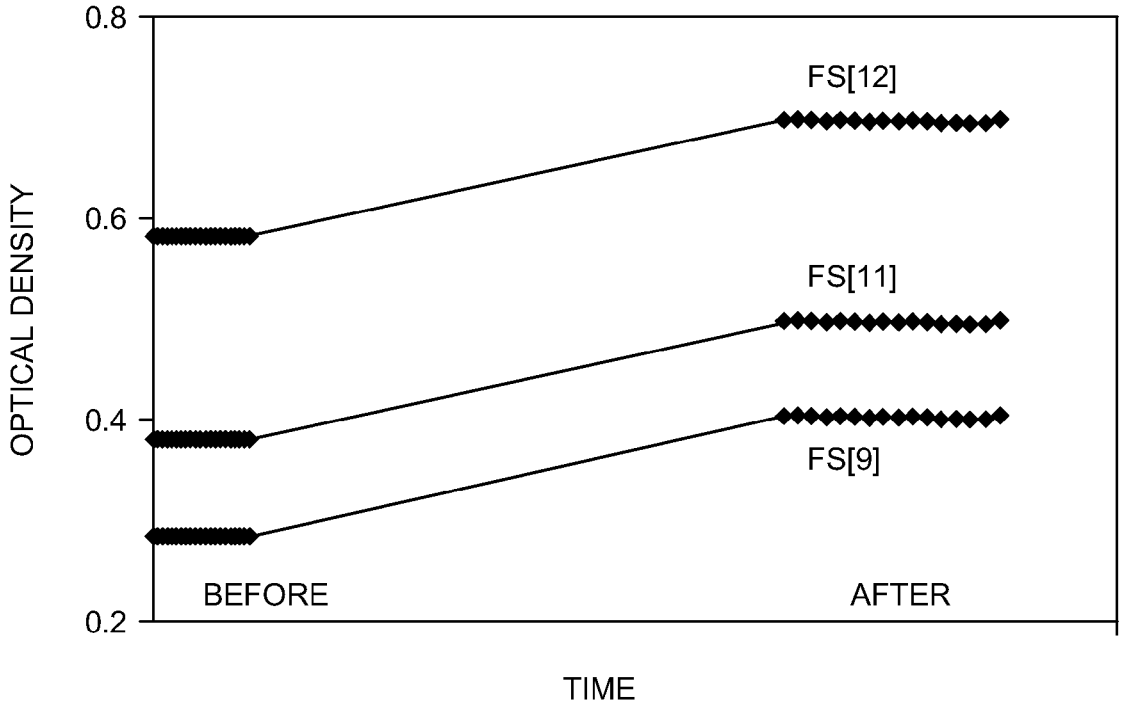
FIG. 13 is a graph of data obtained from an optical density sensor indicating asphaltene precipitation following the injection of carbon dioxide.
Figure 14:
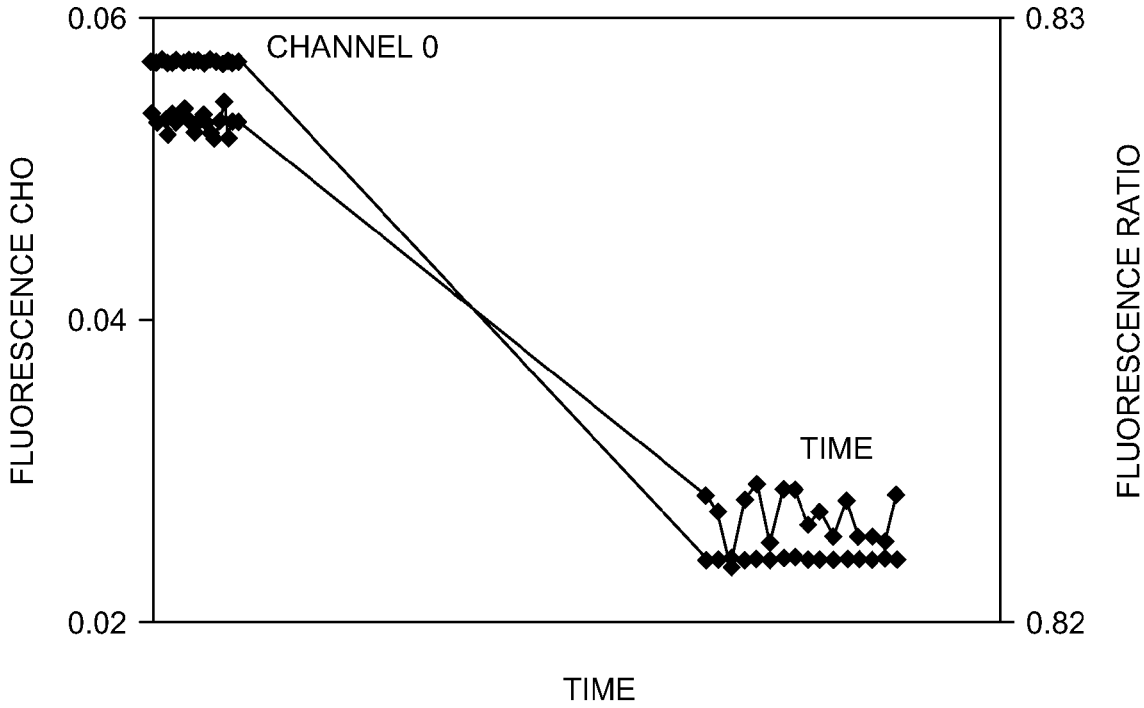
FIG. 14 is a graph of data obtained from a fluorescence sensor indicating asphaltene precipitation following the injection of carbon dioxide.
Figure 15:
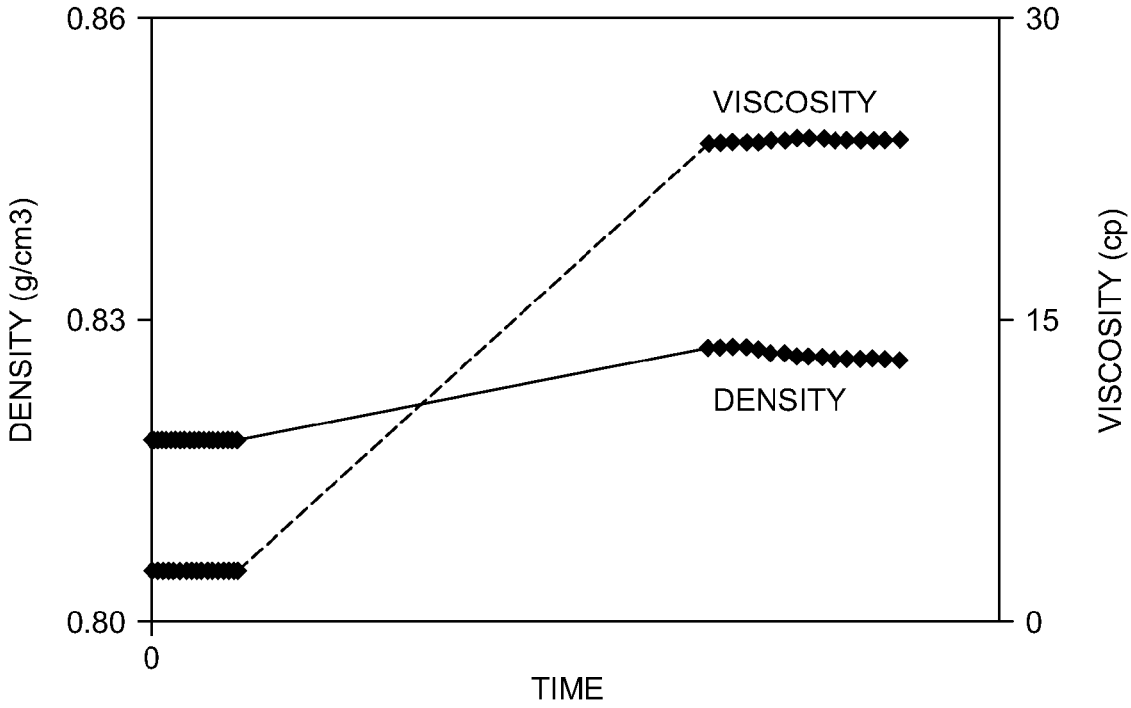
FIG. 15 is a graph of data obtained from a density/viscosity sensor indicating asphaltene precipitation following the injection of carbon dioxide.

Referring now to FIGS. 13-15, by way of example only and not by way of limitation, the results of injecting carbon dioxide into a sample of formation fluid are illustrated by graphs of the output of three different sensors. FIG. 13 shows the output of an optical spectrometer with respect to three different wavelength channels, channels FS9, FS11, and FS12 that are each in the range between 900 to 2200 nanometers, before and after the samples were injected with carbon dioxide test fluid. The notable changes in the optical densities of the fluid samples indicates in each case the precipitation of asphaltene. This may result in a determination that carbon dioxide and the formation fluids are incompatible.

FIG. 14 shows the output of a fluorescence sensor before and after a formation fluid sample was injected with carbon dioxide test fluid. The change in fluorescence (Channel 0) of the fluid samples indicates the precipitation of asphaltene. This graph also indicates the ratio of the resin to asphaltene molecules which is useful in estimating the potential damage caused by the asphaltenes.

FIG. 15 shows the output of a density/viscosity sensor before and after a formation fluid sample was injected with carbon dioxide test fluid. The notable changes in viscosity and density indicate the precipitation of asphaltene.

Figure 16:
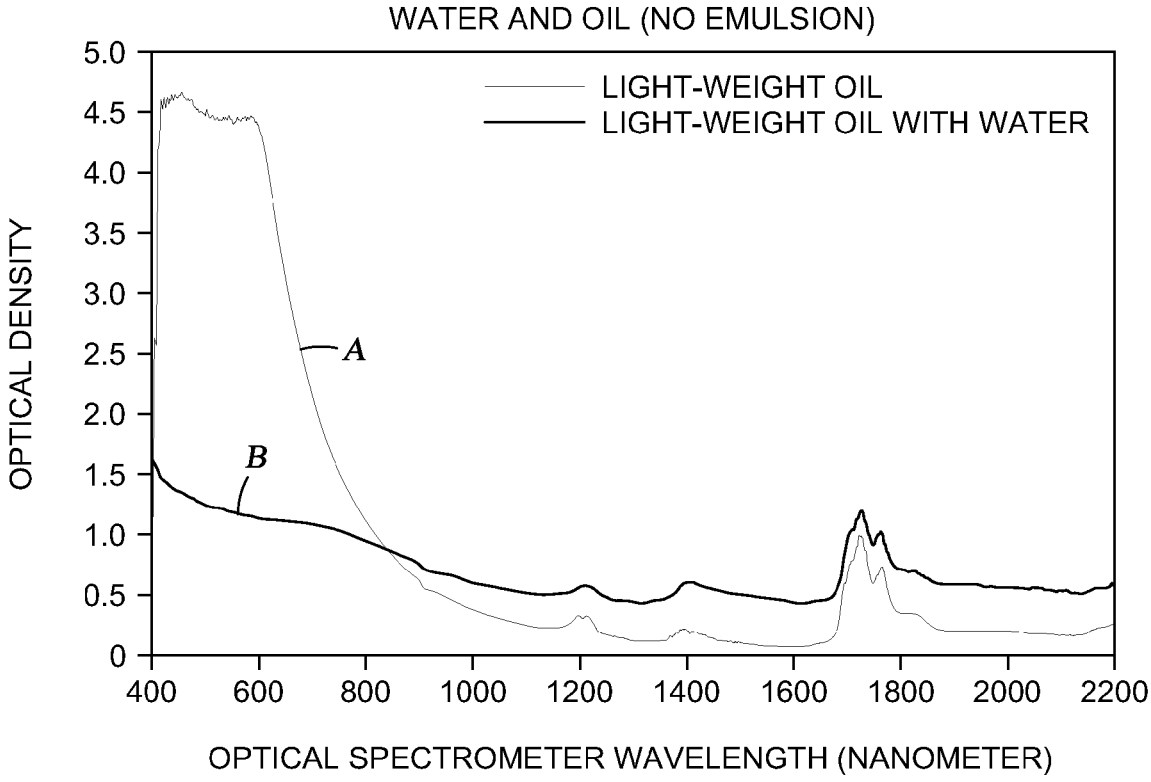
FIG. 16 is a graph of data obtained from an optical spectrometer after injection of water into formation fluid and indicating that no emulsion was formed.
Figure 17:
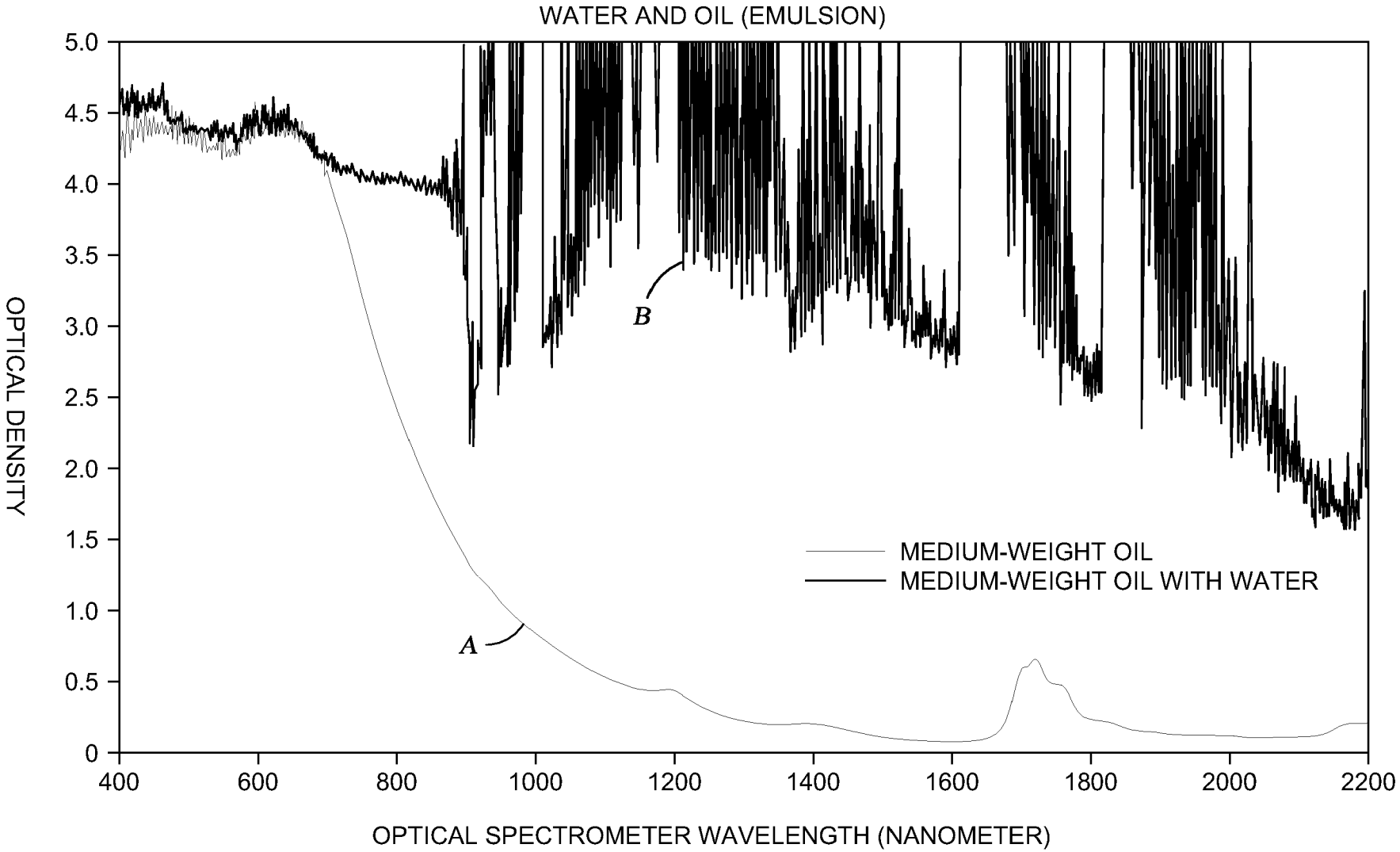
FIG. 17 is a graph of data obtained from an optical spectrometer after injection of water into formation fluid and indicating that an emulsion was formed.

Referring now to FIGS. 16 and 17, by way of example only and not by way of limitation, the results of injecting water into two different formation fluid samples are illustrated by graphs of the output of an optical spectrometer. FIG. 16 shows two spectral plots, A and B. Plot A is a spectral plot of light weight oil before it is injected with water and plot B is a spectral plot of the light weight oil after injection with water. These plots indicate that no emulsion was formed by injecting water as an emulsion would have caused large scattering in the visible and near infrared wavelengths. Thus, it may be determined that water and the light weight oil are compatible. FIG. 17 shows two spectral plots for a different oil sample before and after injection with water. Plot A is a spectral plot of a medium weight oil and plot B is a spectral plot of the medium weight oil after injection with water. The increased and scattered optical density in the 900 to 2200 nanometer wavelength range indicates the formation of an emulsion. Emulsions can form in medium and heavy oils that contain a significant amount of asphaltenes. The asphaltenes act as surfactants with formation or treatment water. The resulting emulsion droplets have high-energy bonds creating a very tight dispersion of droplets that is not easily separated. These surface-acting forces can create both oil-in-water and/or water-in-oil emulsions. Such emulsions require temperature and chemical treating in surface equipment in order to separate. Thus, it may be concluded that water is incompatible with this oil sample.

There have been described and illustrated herein several embodiments of systems and methods for performing fluid compatibility testing and analysis downhole. While particular embodiments have been described, it is not intended that the invention be limited thereto, as it is intended that the invention be as broad in scope as the art will allow and that the specification be read likewise. Thus, while three test fluid chambers and one mixing chamber have been disclosed, it will be appreciated that a greater or fewer number of chambers could be used as well. In addition, while no particular downhole power source has been disclosed, it will be understood that any conventional means of powering a downhole testing tool can be used. Although a pump has been disclosed for delivering fluids to chambers, fluids can be delivered into and out of chambers by means other than a pump. For example, some or all of the fluids can be delivered via gravity, hydraulic pressure, etc. It should be understood that the downhole tool of this disclosure is not limited to mud pulse telemetry or wireline telemetry. It will therefore be appreciated by those skilled in the art that yet other modifications could be made without deviating from the spirit and scope of the claims.

What is claimed is:

1. A downhole tool, comprising:

an inlet disposed on an exterior of the tool for engaging a formation;

a chamber fluidly connected to the inlet, wherein a test fluid is disposed in the chamber;

means for introducing the test fluid from the chamber into the formation;

a sensor arranged to detect a reaction taking place between the test fluid and a fluid within the formation, wherein the reaction is taking place within the formation and is detected within the formation; and a controller operatively coupled to the sensor and configured to make a determination of compatibility of the test fluid with the formation fluid based on the detected reaction.

2. The downhole tool of claim 1 wherein the chamber is a first chamber, and wherein the downhole tool further comprises a second chamber fluidly connected to the first chamber.

3. The downhole tool of claim 2 further comprising:

a third chamber fluidly connected to the first and second chambers; and means for moving the contents of the first and second chambers into the third chamber.

4. The downhole tool of claim 1 wherein the chamber is a mixing chamber having a mixing device configured to mix the contents in the mixing chamber.

5. The downhole tool of claim 1 wherein the sensor is configured to measure a multi-depth resistivity property.

6. The downhole tool of claim 1 wherein the sensor is configured to measure a dielectric property.

7. The downhole tool of claim 1 wherein the sensor is configured to measure a nuclear magnetic resonance (NMR) property.

8. The downhole tool of claim 1 wherein the sensor is configured to measure a neutron spectroscopic property.

9. A downhole tool for testing fluid compatibility with a subterranean formation fluid, comprising:

an inlet disposed on an exterior of the tool for engaging a formation;

a first chamber fluidly connected to the inlet via a conduit;

a second chamber fluidly connected to the first chamber;

means for combining a sample fluid obtained from the formation and a test fluid disposed in the second chamber;

at least one sensor arranged relative to at least one of the first and second chambers such that the sensor detects a reaction taking place between the sample fluid and the test fluid;

a controller operatively coupled to the sensor for making a determination of the compatibility of the test fluid with the fluid sample based on the reaction;

a third chamber fluidly connected to both the first and second chambers, wherein the means for combining includes means for moving the contents of the first and second chambers into the third chamber; and means for introducing the test fluid into the formation, wherein the at least one sensor is arranged such that the sensor can detect a reaction taking place between the test fluid and the formation fluid within the formation, and wherein the controller is configured to make a determination of the compatibility of the test fluid with the formation fluid based on the reaction.

10. The downhole tool of claim 9 wherein the first chamber is a mixing chamber having a mixing device configured to mix the contents in the mixing chamber.

11. The downhole tool of claim 9 wherein the at least one sensor measures a multi-depth resistivity property.

12. The downhole tool of claim 9 wherein the at least one sensor measures a dielectric property.

13. The downhole tool of claim 9 wherein the at least one sensor measures a nuclear magnetic resonance (NMR) property.

14. The downhole tool of claim 9 wherein the at least one sensor measures a neutron spectroscopic property.

* * * * *